US006161404A

United States Patent [19]

Westwinkel

[11] Patent Number: 6,161,404

[45] Date of Patent: Dec. 19, 2000

[54] MOUNTING CLIP FOR A REMOVABLE LOCKING CORE

[76] Inventor: Florian Westwinkel, c/o Wesko Systems Limited, 4580 Eastgate Parkway, Unit 12, Mississauga, Ontario, Canada, L4W 4K4

[21] Appl. No.: 09/333,706

[22] Filed: Jun. 16, 1999

[51] Int. Cl.[7] ..... E05B 9/08

[52] U.S. Cl. ..... 70/370; 70/371

[58] Field of Search ..... 70/370, 367, 368, 70/369, 371

[56] References Cited

U.S. PATENT DOCUMENTS

| | | | |
|---|---|---|---|
| 721,802 | 3/1903 | Horne . | |
| 1,561,254 | 11/1925 | Ledin . | |
| 1,629,172 | 5/1927 | Murphy . | |
| 2,093,038 | 9/1937 | Douglas | 70/370 |
| 2,103,987 | 12/1937 | Kistner . | |
| 2,610,500 | 9/1952 | Poupitch | 70/370 |
| 2,948,141 | 8/1960 | Vahlstrom | 70/370 |
| 3,046,777 | 7/1962 | Schlage | 70/371 |
| 3,190,092 | 6/1965 | Patriquin | 70/370 |
| 3,452,564 | 7/1969 | Hallgren . | |
| 4,363,230 | 12/1982 | Lipschutz | 70/370 |
| 4,873,852 | 10/1989 | Neyret | 70/451 |
| 4,890,467 | 1/1990 | Krause et al. | 70/369 |
| 4,910,982 | 3/1990 | Dana | 70/370 |
| 4,936,640 | 6/1990 | Pratzer | 312/221 |
| 5,056,877 | 10/1991 | Westwinkel | 312/221 |
| 5,062,678 | 11/1991 | Westwinkel | 312/221 |
| 5,109,685 | 5/1992 | Westwinkel | 70/368 |
| 5,186,031 | 2/1993 | Janssen et al. | 70/277 |
| 5,251,467 | 10/1993 | Anderson | 70/370 |
| 5,435,159 | 7/1995 | Ramsauer | 70/370 |
| 5,479,800 | 1/1996 | Myers | 70/365 |
| 5,704,234 | 1/1998 | Resch | 70/371 |
| 5,752,400 | 5/1998 | Kim | 70/368 |
| 6,014,877 | 1/2000 | Shen | 70/371 |

OTHER PUBLICATIONS

Ciocean Product Drawings pp. 2.11–2.12.
Ciocean Component Parts Sheet pp. 1.107 and 1.108.

*Primary Examiner*—Teri Pham
*Attorney, Agent, or Firm*—Arent Fox Kintner Plotkin & Kahn PLLC

[57] ABSTRACT

The invention relates to a mounting clip used to secure a lock housing within an opening in a storage compartment. The mounting clip is provided with an arcuate clamp to secure the clip to the housing. The clip may be mounted on the housing at a point outside of the compartment, prior to installation of the housing into the opening in the compartment wall. The housing may include a channel or other elements to firmly secure the clip against accidental displacement from the housing during installation or subsequent operation. The clip includes a spring like arm that may be compressed to abut closely against the housing during insertion into the wall of the compartment. After installation is complete, the spring like arm extends away from the housing. When the arm is extended, it presses firmly against the wall of the compartment to prevent removal of the lock housing from the compartment wall.

19 Claims, 5 Drawing Sheets

MOUNTING CLIP FOR A REMOVABLE LOCKING CORE

FIELD OF THE INVENTION

The invention relates to an improved mounting clip for use in combination with locking mechanisms for office furniture, cabinets and other storage compartments. In particular, the clip may be used to secure locking core housings within cabinets and other storage compartments. The invention also relates to certain improvements provided in the locking housing.

BACKGROUND OF THE INVENTION

Locking mechanisms are commonly used to secure storage compartments in office furniture including desks, cabinets, credenzas and other storage facilities. Conventional locking mechanisms have been used with storage facilities including, in some instances, anti-tip features designed to prevent cabinets and other storage units from tipping over accidentally if multiple drawers are allowed to open simultaneously. For example, U.S. Pat. Nos. 4,936,640, 5,056,877 and 5,062,678 show several examples of anti-tip mechanisms used in prior locking cabinet systems. Prior locking storage systems have used rotating conventional locking core systems.

An example of an earlier locking core system is described in U.S. Pat. No. 5,109,685. The noted reference shows an example of a removable locking core with a housing that is mounted on a cabinet drawer by exterior mounting screws. In other systems, locking apparatuses have been mounted by using conventional clips that must be attached from a position within the interior of the storage unit. During installation, the installer must securely hold the locking apparatus in place in the storage unit while trying to secure the mounting clip to the locking assembly portion positioned within the interior of the locking storage unit.

In some instances, locking core housings have been provided with retainer springs that may be installed through an opening in the front wall of drawer, cabinet or other installation site. U.S. Pat. No. 5,435,159 to Ramsauer discloses a complex retainer spring that is secured to a cylindrical lock housing by means of a bolt, screw or rivet. In some instances, the retainer spring may be installed prior to installation of the locking apparatus (assembly) in the locking compartment. However, the use of such a clip requires additional manufacturing steps in making the spring and additional means to secure the spring to the locking core housing. For example, if screws are used to secure the spring to the housing, suitable preformed openings must be provided in the housing to receive the screws. In other instances, threaded openings may also be necessary for this purpose. Where screws and bolts are used, for example, the housing must be adequately reinforced to receive and hold the screws or bolts securely after installation. Again, such features will add to the overall cost and effort required to manufacture and assemble the components.

In other instances, other special features may be required on the springs or on the housing in order to permit suitable fastening of the spring to the housing. Many of these features will add significant costs to the overall cost of making and installing the locking assembly units. Where certain added features require low tolerances in manufacturing and assembly, total costs are typically increased for those locking assemblies.

U.S. Pat. No. 3,190,092 to Patriquin refers to a unitary cylindrical housing that is molded from plastic. Patriquin discloses a front mounting cylindrical housing with integral retainers used to secure the locking assembly in place. However, the cylindrical housing in Patriquin is practically limited to installations that will permit use of plastic housings. Many installations require assemblies manufactured from other materials. The physical characteristics and properties of isotropic materials such as plastics used throughout the unitary housing in this reference may not be suitable for certain applications.

DISCLOSURE OF THE INVENTION

The present invention relates to a mounting clip that may be secured to a locking core housing without necessarily using welds, rivets, screws or bolts to hold the clip in place after installation. The improved mounting clip may be attached to the housing at the installation site or away from the installation site, if desired. Special tools are not required in typical installations. Similarly, if required, the clip of the present invention may be promptly detached from a locking core housing in those instances where the locking core assembly is in need of repair or other service. For example, it may be necessary to remove the entire locking core assembly from the storage compartment. The improved clip may be removed by prying or sliding the clip from the side of the housing.

By comparison, conventional systems in the prior art often require special tools to permit removal of conventional retainers or springs, or in some cases, considerable physical effort and time are required to remove the retainers or springs from conventional housings.

In one aspect of the invention, the improved mounting clip comprises an arcuate band or member. The arcuate member is configured to generally conform with a corresponding outer portion of the lock housing and is generally made of flexible, resilient material to clamp or grasp the housing. Typically, the housing is cylindrical or elongate in shape and has a longitudinal axis. The overall configuration of the arcuate portion of the clip substantially conforms with the corresponding outer portion of the lock housing to provide for a snug fit. The arcuate member is configured to snap into place, grasping the housing, circumferentially about the longitudinal axis.

The improved clip may be provided with one or more retaining arms, extending parallel to the longitudinal axis. A retaining arm comprises a biased end portion, projecting outwardly from the longitudinal axis. The biased end portion is flexible and resilient to permit temporary compression of the end portion during installation of a locking core assembly. The terminal portion of the retaining arm may be provided with an inwardly projecting flange. The flange may be provided to further inhibit the accidental or unauthorized removal of an installed locking core assembly from a storage compartment. In addition, the flange provides for a secure, snug fit of the assembly, including the housing, within the storage compartment wall.

In other embodiments, two or more retaining arms may be provided on a mounting clip of the present invention. In some embodiments, mounting clips may be configured so that only one mounting clip may be used per lock housing. In other embodiments, the mounting clips may be configured so that two mounting clips may be secured to a lock housing at the same time. The two clips may be identical, if that is desired. In other embodiments, it may be desirable to provide more than two clips on each housing, although some of the clips may be configured for placement at different locations along the length of the longitudinal axis.

In yet another embodiment of the invention, the improved mounting clip defines a longitudinal axis. The clip includes an arcuate portion that extends radially about the longitudinal axis. The mounting clip comprises at least one elongate body extending from the arcuate portion, parallel to the longitudinal axis. The elongate body comprises a first arm portion that extends outwardly away from the longitudinal axis when it is in the second position. The first arm portion is spring-like and is adapted to operate between a first compressed position and a second extended position. The first arm portion of the elongate body has an abutting end or flange projecting inwardly toward the longitudinal axis.

In yet another embodiment of the present invention, an improved locking assembly is provided. The assembly may be used in securing locking cores in furniture, cabinets and other structures including storage compartments. The assembly comprises a lock housing and a mounting clip. The assembly may be inserted into a corresponding receptacle, such as an opening in an exterior wall of the storage compartment. The lock housing and mounting clip are configured so that the clip may be secured to the housing outside of the storage compartment. Thereafter, the assembled housing and clip may be inserted together into the corresponding receptacle. While passing into the receptacle, the first spring-like portion of the clip is compressed into the first position. Once the assembly has been fully inserted, the first portion returns to the second position. The flange provided on the first portion abuts against the inner wall of the storage compartment to prevent withdrawal of the locking core assembly. The flange portion of the clip is configured to fit snugly up against the inner wall. The assembly, once installed into the storage compartment, cannot be accidentally removed from the receptacle. The assembly may be removed by depressing the first portion to the first position and then withdrawing the assembly from the receptacle. Alternatively, the storage compartment may be opened and the clip may be removed from the housing while the assembly is inside the receptacle. In this second instance, once the clip is removed, the housing may be withdrawn from the receptacle.

BRIEF DESCRIPTION OF THE DRAWINGS

The following drawings are included to illustrate several examples of embodiments of the present invention.

DETAILED DESCRIPTION OF PREFERRED EMBODIMENTS

Figure 1:
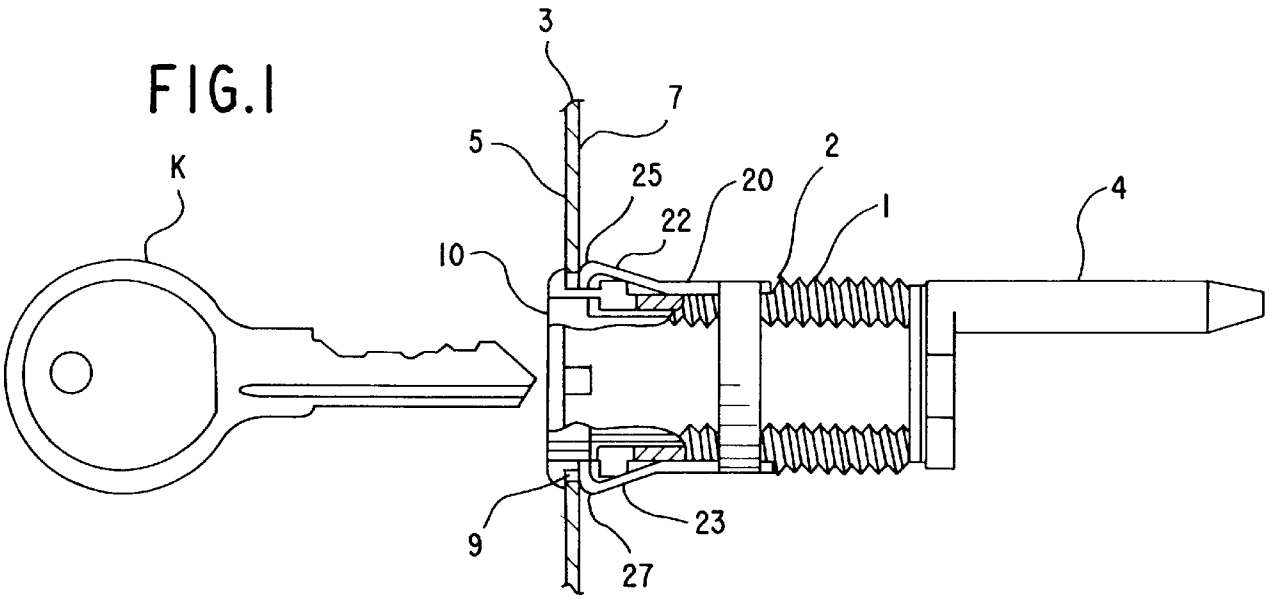
FIG. 1 is an exploded side view, in partial section, of an embodiment of a locking mechanism, including a key, lock housing, mounting clip and driver installed in a compartment wall.
Figure 1A:
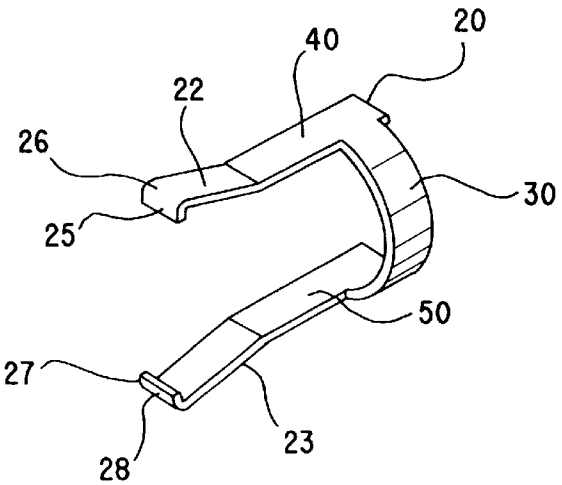
FIG. 1A is a perspective view of one embodiment of a mounting clip of the present invention.

FIGS. 1 and 1A show a preferred embodiment of the present invention. A locking core assembly 2 is shown in partial sectional view. In particular, the assembly 2 is shown installed in the outer wall 3 of a storage compartment. The locking core assembly includes an elongated lock housing 1 that is generally cylindrical in shape. It will be understood in the art that the overall shape of the removable lock housings may vary according to the particular applications under consideration. In many instances, the lock housing may have exterior threading, flats and other precast features intended for use in particular applications, but not in others. In general, the overall shape of the housing will define a longitudinal axis. In the particular embodiment shown in FIGS. 1 and 1A, a driver 4 is secured to a rotatable locking core mechanism (not shown) located within the housing 2. The core rotates about the longitudinal axis. A key K is inserted into a key slot (not shown) in the face plate 10 of the locking core (not shown). The key K may be used to rotate the locking core, to in turn activate the driver 4. The assembly includes a mounting clip 20 of the present invention. The mounting clip 20 includes an arcuate band 30 that is generally C shaped. The arcuate band 30 extends radially about an axis that generally coincides with the longitudinal axis of the lock housing 1. The arcuate band may be made of a suitable, flexible and resilient material that will allow the band to clamp on to the exterior of the lock housing 1. Again, it will be understood by those skilled in the art that there may be variations in shape that will not affect the efficacy of the invention. However, it is preferred that the arcuate band 30 be configured to closely follow the contour of the corresponding exterior surface of the lock housing 1. If the lock housing is irregularly shaped, with for example flats or edges, the band 30 may be shaped in a similar manner to better engage the housing 1 to resist displacement of the clip 20 from the housing 1 after installation.

The illustrated embodiment has upper arm 40 and lower arm 50. The upper and lower arms 40, 50 extend from the ends of the arcuate band 30, parallel to the longitudinal axis. Upper arm 40 includes an upper spring section 22 that under normal circumstances projects outwardly from the longitudinal axis. The terminal portion of upper spring section 22 ends in a flange 25. Similarly, flange 27 forms the terminal portion of lower spring section 23. In the preferred embodiment, the clip 20 may be stamped or otherwise manufactured as a single piece, from a sheet of suitable material.

The assembly 2 is shown in the installed position, interior of a storage compartment. When installed, upper and lower spring sections 22, 23 are extended toward their normal positions. Corresponding flange portions 25, 27 engage with the inner wall surface 7 of the exterior compartment wall 3 to hold the housing firmly in place, within the receptacle or opening 9 in the wall 3.

During installation, the lock housing 1 and the mounting clamp are inserted together from the exterior of the compartment structure to the interior through opening 9. (With reference to FIG. 1, this installation step corresponds to movement from left to right, through the opening 9, and into the interior of the compartment.)

During installation, upper and lower spring sections 22 and 23 are compressed when passing through opening 9. When the spring sections 22 and 23 are fully compressed, there is sufficient clearance within the opening 9 to permit the mounting clip and housing to pass through the opening 9. After passing through the opening, the spring sections 22 and 23 return to their normally extended positions. Terminal flange portions 25, 27 snugly engage the inner wall 7 of the compartment. The terminal flange portions 25, 27 extend outwardly beyond the perimeter of the opening 9 to engage the inner wall and prevent withdrawal of the assembly from the locking compartment.

Figure 2A:
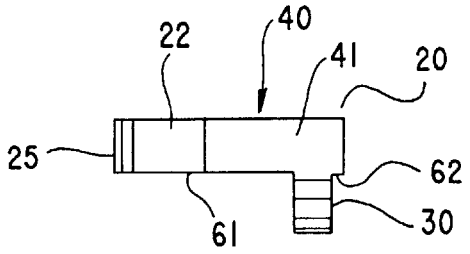
FIG. 2A is a plan view of the mounting clip shown in FIG. 1A.
Figure 2B:
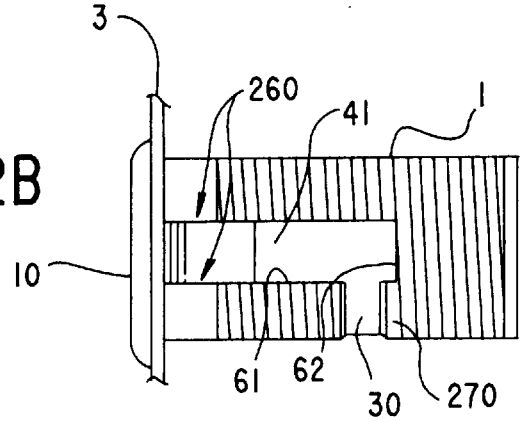
FIG. 2B is a plan view of the mounting clip of FIG. 1A together with a lock housing.
Figure 2C:
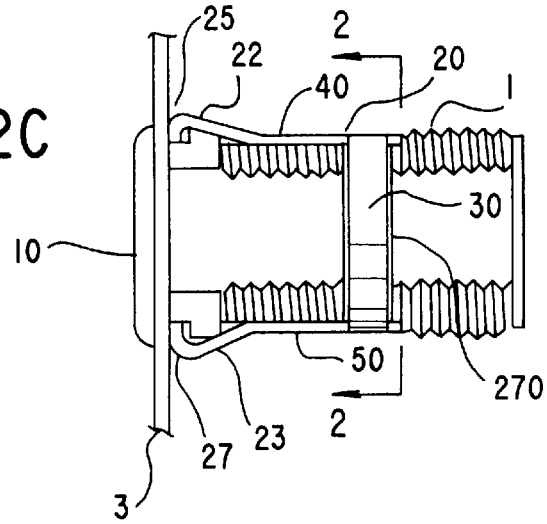
FIG. 2C is an elevation of the embodiment shown in FIGS. 2A and 2B.

In the preferred embodiment of the present invention, the housing 1 is provided with a channel for receiving the arcuate band 30. With reference to FIGS. 2B and 2C, lateral channel 270 is of sufficient dimensions to receive arcuate clamp member 30. The channel 270 is positioned to place the mounting clip at an ideal distance from the inner wall surface of wall 3. Longitudinal channel 260 is also provided to receive the lower arm portion 41 of clip 20. Edge 61 and extension edge 62 engage with a corresponding channel wall of channel 260 when the clip is installed into its desired position. The clip is configured of resilient, flexible material with portions 41,30 that correspond to the contours of channels 260, 270. The clip portions 41, 30 snap into position when the clip 20 is installed.

It is possible to use other features to retain the clip in a desirable position on the housing. For example, in some embodiments, a rim or other raised posts or elements (not shown) may be used to limit longitudinal displacement of the clip along the housing during installation or later operation. Channels having dimensions corresponding to the dimensions of the clip (as exemplified by channels 260 and 270) are preferred. The placement of the arcuate member within the corresponding channel reduces the clearance necessary for the installed clip 20 when it is inserted through the opening 9 during installation along with the housing 1. In many instances it will be relatively inexpensive and convenient to form the desired channels 260, 270 when manufacturing the housing. For example, where the housing is made of die cast metal, the channel may be included with little inconvenience or cost.

Figure 2:
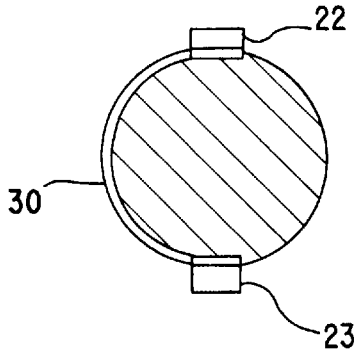
FIG. 2 is a sectional view along line 2—2 in FIG. 2C.

With reference to FIGS. 2A, 2B, 2C, and 2, the mounting clip 20 shown in FIGS. 1 and 1A is shown installed on a housing 1. In FIG. 2, the sectional view illustrates the outward projection of upper and lower spring sections 22 and 23 when the mounting clip 20 is installed.

Figure 3A:
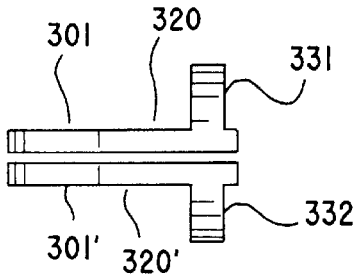
FIG. 3A is a plan view of another embodiment of a mounting clip of the present invention.
Figure 3B:
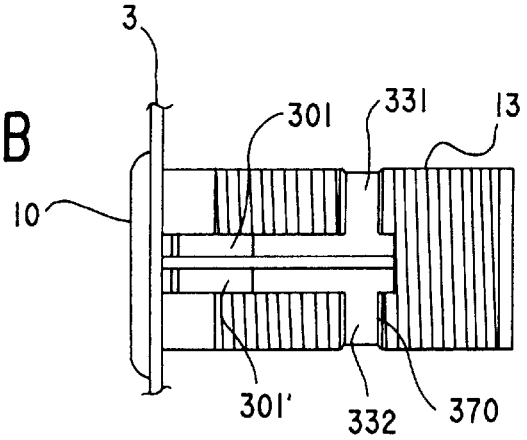
FIG. 3B is a plan view of the mounting clips of FIG. 3A together with a lock housing.
Figure 3C:
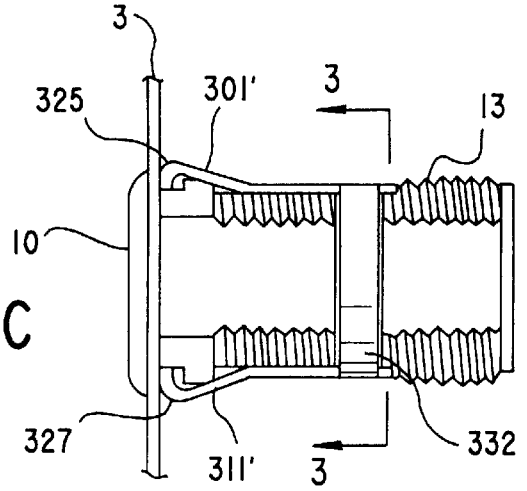
FIG. 3C is an elevation of the embodiment shown in FIGS. 3A and 3B.
Figure 3:
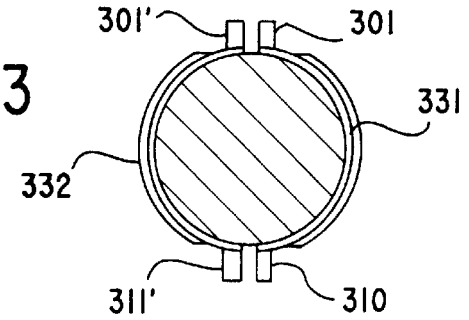
FIG. 3 is a sectional view along line 3—3 in FIG. 3C.
Figure 4A:
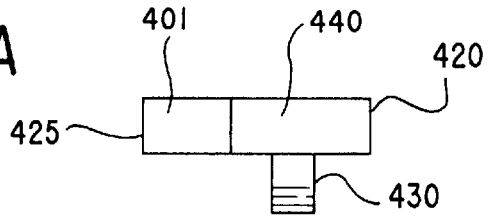
FIG. 4A is a plan view of another embodiment of a mounting clip of the present invention.
Figure 4B:
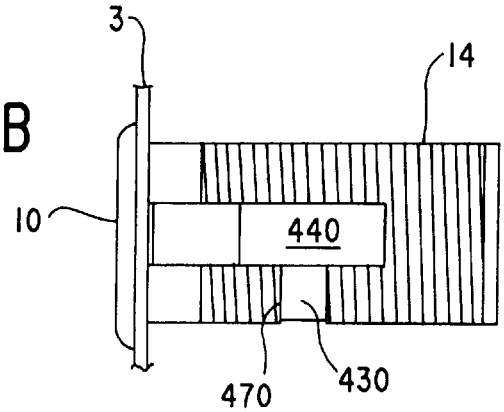
FIG. 4B is a plan view of the mounting clip of FIG. 4A together with a lock housing.
Figure 4C:
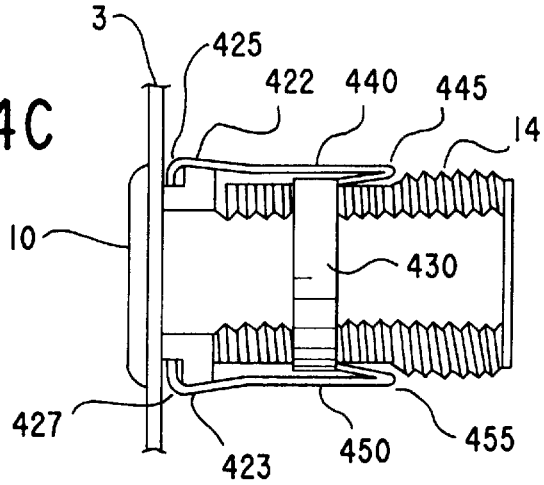
FIG. 4C is an elevation of the embodiment shown in FIGS. 4A and 4B.
Figure 4:
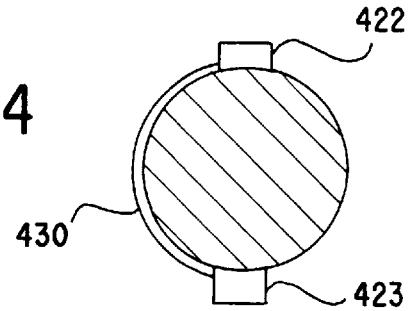
FIG. 4 is a sectional view along line 4—4 in FIG. 4C.

With reference to FIGS. 3A, 3B, 3C, and 3, a pair of mounting clips 320 and 320' are mounted on housing 13. Clip 320 has an arcuate clamping portion 331 which nests within a portion of channel 370. Channel 370 extends about the housing 13 to receive clamping portions 331 and 332 of clips 320 and 320' respectively. The clips 320 and 320' include respective spring portions 301 and 301'. In FIG. 3C, flange portion 325 of spring 301' and flange 327 of lower spring 311' are shown in contact with the inner surface of wall 3 of the storage compartment.

Although FIGS. 3A, 3B, 3C, and 3 show a pair of clips each having upper and lower spring portions, other configurations and embodiments may be desirable. For example, in some instances, it may be desirable to have only one spring arm provided on a mounting clip. In some embodiments, the spring arm may be located at an intermediate point along the corresponding arcuate clamping member.

FIGS. 4A, 4B, 4C, and 4 show yet another embodiment of the mounting clip of the present invention. Mounting clip 420 is shown installed in a corresponding channel 470 provided on the corresponding housing 14. The clip 420 is provided with a mounting clamp member 430 which nests within channel 470. The clamp member is preferably made of a flexible, resilient material and configured to firmly grip about the outer perimeter of the housing. The channel and clamp member may also be configured to inhibit accidental lateral displacement of the mounting clip from the housing during installation or subsequent operation.

In this embodiment, upper arm 440 and lower arm 450 are provided with elbow segments 445 and 455 respectively. In some applications, the available clamping position (corresponding to the position of channel 470) may be located relatively close to the wall 3. In those instances, it may desirable to extend the relative length of the upper and lower arms 440 and 450 by providing corresponding elbow elements 445 and 455. Spring portions 422, 423 are provided with respective flanges 425 and 427. The flanges 425 and 427 fit snugly against wall 3 to hold the housing assembly in place after installation.

In the preferred embodiment shown in FIGS. 1 and 1A, and particularly in those instances where the clip 20 is made from a relatively thin band, the flanges 25, 27 provide added resistance to longitudinal movement of the housing after installation. The flange may be used as an added spring element. Flange segments 26 and 28 may be manufactured so that they are sloped at an angle to the vertical wall 3 in their uninstalled condition. Following installation on the housing 1 and insertion into the storage compartment, the flange segments 26 and 28 are deflected during the movement of the spring portions 22, 23 outwardly from the longitudinal axis. The flange elements engage with the surface of the inner wall to provide added resistance against longitudinal movement of the housing outward through the opening 9. Flange segments 26, 28 may even be scored or textured to better engage the inner surface of wall 3.

Figure 5A:
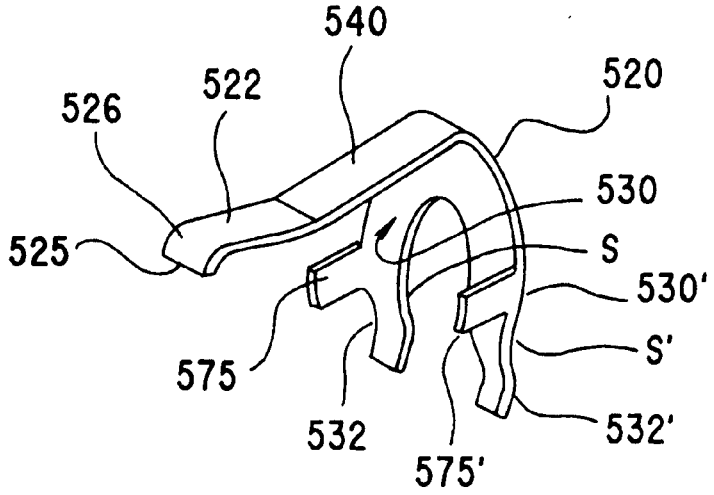
FIG. 5A is an elevational view of a partial section of a lock assembly of the present invention.
Figure 5:
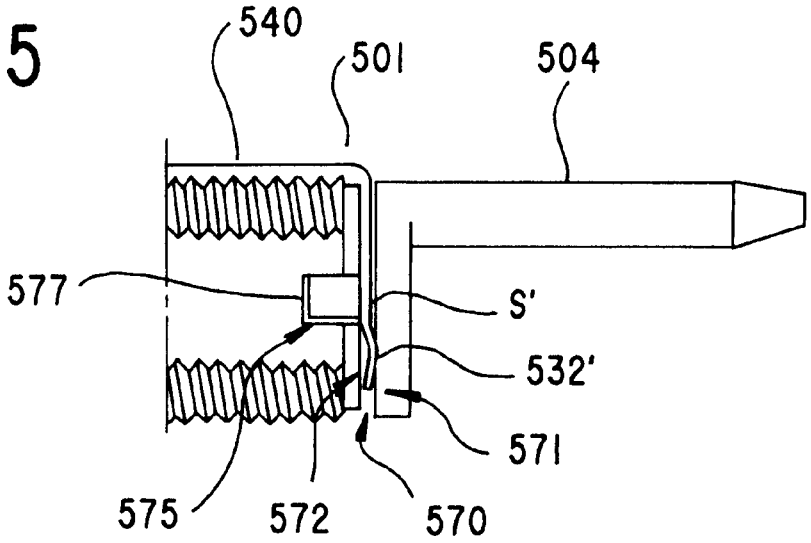
FIG. 5 is a perspective view of another embodiment of a mounting clip of the present invention.

FIGS. 5 and 5A show another embodiment of the mounting clip. Mounting clip 520 is made from a single, stamped or like formed material. The clip 520 is provided with an arm 540 and a spring portion 522 of sufficient length to engage the inner wall surface of the storage compartment. The spring portion terminates in a flange portion 525. The flange 525 has an engagement surface 526 which contacts the inner wall surface. The clip 520 is mounted on the housing 501 by engagement in a channel 570 formed between terminal edge 572 of the housing and adjacent end wall 571 of the driver 504. The clip 520 is also provided with flanges 575, 575' which engage with longitudinal corresponding channel segments 577. The flanges 575, 575' and corresponding channel segments 577 are configured to allow the clip 501 to be snapped into position during installation. The legs 530, 530' are generally S-shaped when viewed in profile, providing scalloped portions S, S' and bend portions 532, 532' which may be used to act as a washer between the housing 501 and the driver 504. The legs 530, 530' may also be shaped by bending or other means to provide a tensioning washer between the housing 501 and driver 504, to enhance the operation of the driver.

In some instances, it may not be necessary to provide flanges on the spring portions. For example, the thickness or configuration of a spring arm may be such that an adequate contact area (to impact against the compartment wall) is presented by the terminal end of the spring portion itself. In other embodiments, the terminal ends of the spring portions may be configured in other ways to improve contact between the wall and the terminal ends of the spring arms.

The mounting clip of the present invention may be manufactured from a variety of flexibly resilient materials having physical characteristics adequate for the intended applications. In some instances, treated metals or alloys may be used. In some instances, suitable plastics may be employed.

It is also to be understood that the spring arms may be configured in a manner that will permit them to be compressed against the housing in certain circumstances, to permit removal of the housing and the clip from the compartment without having to first unlock or open the compartment. For example, the face plate 10 may be adapted so that it can be removed along with the locking core. Master keys are often used to extract removable locking cores. The face plate may also be designed for removal after the locking core is removed. Once the face plate is removed, a tool such as pliers or similar clamping tool may be inserted into the compartment interior through the opening 9. If necessary, additional clearance may be provided in the wall, or specially designed access channels may be provided in the wall 3 to limit access to special tools only. Thereafter, the appropriate tool may be used to engage the ends of arms 22 and 23 and compress them so that the housing and clamp may be withdrawn back through the opening without first opening the compartment.

Further embodiments and modifications of the mounting clip and housing assemblies s described herein will occur to those skilled in the art and such modifications and embodiments are intended to be covered by the following claims.

I claim:

1. A mounting clip to secure a lock housing to a wall of a storage compartment, the lock housing defining a longitudinal axis and longitudinal outer surface extending about the longitudinal axis, the outer surface defining an abutment, the clip comprising:

(a) a mounting end defining an arcuate flexible band opening to a first position to receive the housing and closing to a second position to clamp the outer surface adjacent the abutment, (b) an elongate element extending from the mounting end, defining a first plane parallel to the longitudinal axis upon engagement of the mounting end with the outer surface, the elongate element comprising a terminal portion, (c) the terminal portion being biased for movement relative to the first plane from a first position parallel to the longitudinal axis to a second position wherein the terminal portion defines a second plane extending away from the longitudinal axis, and (d) the terminal portion comprising a flange, the flange defining a third plane projecting from the second plane, the flange further defining a terminal edge extending transversely of the terminal portion to engage the wall of the storage compartment and the terminal edge extending parallel to the wall upon engagement with the wall.

2. The clip claimed in claim 1 comprising a second elongate member extending from the mounting end.

3. The clip claimed in claim 2 wherein the mounting end defining said arcuate band has a first end and a second end, the first elongate member extending from a position adjacent the first end of the band, and the second elongate member extending from a position adjacent the second end of the band.

4. The clip claimed in claim 2 wherein the flange extends inwardly toward the longitudinal axis.

5. An improved mounting clip for use in a locking core apparatus for securing a limited access compartment in a locked position, the compartment comprising an exterior wall defining an opening extending between an exterior face and an interior face, wherein the locking core apparatus comprises:

(a) an elongate housing defining a longitudinal axis, the housing comprising a first key end and a second driver end, (b) the elongate housing is inserted into the opening from a position adjacent to the exterior face, (c) the elongate housing comprising a retainer positioned on an exterior longitudinal surface of the housing between the first and second ends of the housing, wherein the improved mounting clip comprises:

(d) an elongate body comprising a first mounting portion defining a first plane and a second abutment portion extending from the first plane, (e) the mounting portion comprising an engagement element to secure the elongate element to the retainer, (f) the abutment portion moving relative to the first plane between a first position wherein the the abutment portion is positioned adjacent to the housing, and a second position wherein the abutment portion defines a second plane projecting from the first plane, and (g) the abutment portion comprising a flange defining a third plane projecting from the second plane, the flange defining an elongate terminal edge to engage the interior face of the exterior wall when the abutment portion is in the second position.

6. The mounting clip in claim 5 wherein the abutment portion is biased for movement from the first to the second positions.

7. The mounting clip in claim 5 wherein the elongate body is flexibly hinged between the mounting portion and the abutment portion.

8. The mounting clip of claim 6 wherein the engagement element defines an arcuate flexibly resilient band extending along and radially about a central axis.

9. The mounting clip as claimed in claim 5 wherein the engagement element comprises a flexibly resilient arcuate band to engage a corresponding recess defined by the exterior of the housing.

10. The mounting clip as claimed in claim 9 wherein the arcuate band comprises first and second terminal ends, the arcuate band comprising a second like elongate body, the first and second bodies extending in parallel from respective locations adjacent the first and second terminal ends of the band.

11. The mounting clip as claimed in claim 10 wherein the flange extends inwardly toward the central axis.

12. The mounting clip as claimed in claim 11 formed from a single piece of flexibly resilient material.

13. A locking apparatus for installation in the wall of a locking compartment, the locking compartment operating between locked and unlocked positions, the apparatus comprising:

an elongate housing having first and second open ends and further defining an exterior surface, said housing defining a first longitudinal axis and a chamber extending between said ends, and an arcuate channel defined by the exterior surface and extending radially about the first longitudinal axis, a locking core operable by one or more keys, the locking core being rotatably secured within the longitudinal chamber, a mounting clip comprising:

(a) an elongated member having a first end and a second end, the first end comprising a flexibly resilient arcuate band to secure the clip within the arcuate channel defined by the exterior surface of the housing, the first end further comprising a first segment defining a first plane, and a second segment defining a second plane extending between the first segment and the second end, (b) the second end pivotably moving between first and second positions, the second end being positioned adjacent the housing when in the first position, and the second end extending away from the housing when the second end is in the second position, the second end being biased for movement from the first position to the second position, and (c) the second end defining a flange projecting from the second plane, the flange defining a terminal edge extending transversely across a second longitudinal axis defined by the elongated member, the terminal edge extending parallel to and engaging the wall of the locking compartment when the second end is in the second position.

14. The locking apparatus claimed in claim 13 wherein the second end of the mounting clip is movable from the second position to the first position, such movement being activated from a position exterior of the locking compartment, to permit withdrawal of the locking apparatus from the wall of the locking compartment.

15. The locking apparatus claimed in claim 13 wherein the first and second segments of the elongated member are received within an elongated channel defined by the exterior surface of the housing when the second end is in the second position.

16. The locking apparatus claimed in claim 15 comprising a second like elongated member extending from the arcuate band parallel to the first elongated member.

17. The locking apparatus claimed in claim 16 wherein the arcuate band defines first and second opposite terminal ends, and the first and second elongated members extend from the first and second opposite terminal ends.

18. The locking apparatus of claim 15 wherein the exterior surface of the housing defines a longitudinal channel to receive the elongated member when the second end is in the second position.

19. The locking apparatus of claim 17 wherein the exterior surface of the housing defines longitudinal channels to receive the first and second elongated members when the corresponding seconds ends of the elongated members are in the second position.

* * * * *